US007744081B2

(12) United States Patent
Ikeda

(10) Patent No.: US 7,744,081 B2
(45) Date of Patent: Jun. 29, 2010

(54) IMAGE FORMING APPARATUS

(75) Inventor: Taro Ikeda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 312 days.

(21) Appl. No.: 11/685,381

(22) Filed: Mar. 13, 2007

(65) Prior Publication Data

US 2007/0228640 A1 Oct. 4, 2007

(30) Foreign Application Priority Data

Apr. 3, 2006 (JP) ..... 2006-102578

(51) Int. Cl.
*B65H 3/14* (2006.01)

(52) U.S. Cl. ..... 271/98; 271/4.02; 271/265.01; 271/276

(58) Field of Classification Search ..... 271/4.02, 271/98, 265.01, 276
See application file for complete search history.

(56) References Cited

U.S. PATENT DOCUMENTS

| | | | | |
|---|---|---|---|---|
| 5,645,274 | A | 7/1997 | Ubayashi et al. | |
| 5,692,492 | A | 12/1997 | Pascal et al. | |
| 5,876,030 | A * | 3/1999 | Dobbertin et al. | 271/13 |
| 5,921,540 | A * | 7/1999 | Acquaviva et al. | 271/98 |
| 5,988,629 | A * | 11/1999 | Burlew et al. | 271/152 |
| 6,247,695 | B1 * | 6/2001 | Linder et al. | 271/265.04 |
| 6,279,896 | B1 * | 8/2001 | Linder et al. | 271/98 |
| 6,505,832 | B2 * | 1/2003 | Moore et al. | 271/265.01 |
| 6,543,759 | B2 * | 4/2003 | Yamaguchi et al. | 271/98 |
| 7,540,489 | B2 * | 6/2009 | Kushida | 271/98 |
| 7,635,125 | B2 * | 12/2009 | Ikeda | 271/31 |
| 2002/0005610 | A1 * | 1/2002 | Moore et al. | 271/11 |
| 2003/0057633 | A1 | 3/2003 | Okazaki et al. | |
| 2006/0012107 | A1 * | 1/2006 | Ueda et al. | 271/98 |
| 2006/0017209 | A1 | 1/2006 | Kushida et al. | 270/37 |
| 2006/0017218 | A1 | 1/2006 | Kawata et al. | 271/207 |
| 2006/0019811 | A1 | 1/2006 | Ikeda et al. | 493/444 |
| 2006/0288893 | A1 | 12/2006 | Ikeda | 101/407.1 |
| 2007/0161489 | A1 | 7/2007 | Ikeda et al. | 493/144 |
| 2007/0194514 | A1 | 8/2007 | Ikeda | 271/97 |

FOREIGN PATENT DOCUMENTS

| | | |
|---|---|---|
| EP | 1 618 803 | 1/2006 |
| GB | 2 406 283 | 3/2005 |
| JP | 07-196187 | 8/1995 |
| JP | 2003-095467 | 4/2003 |
| JP | 2003-171024 | 6/2003 |
| JP | 2004-097617 | 4/2004 |

OTHER PUBLICATIONS

European Patent Office Official Search Report in application No. EP 07 10 5537, completed Jul. 10, 2007.

* cited by examiner

*Primary Examiner*—Patrick Mackey
*Assistant Examiner*—Howard Sanders
(74) *Attorney, Agent, or Firm*—Fitzpatrick, Cella, Harper & Scinto

(57) ABSTRACT

A sheet surface detecting mechanism, which detects the upper surface of sheets stacked on a tray, including: a sensor disposed in a position spaced apart from a conveying portion; a pivotal sensor flag turning the sensor ON/OFF; and a sheet surface detecting member being disposed in parallel with the sheets stacked on the tray, moving in a vertical direction while causing the sensor flag to pivot in contact with the upper surface of the sheets, and turning the sensor ON/OFF via the sensor flag.

4 Claims, 16 Drawing Sheets

IMAGE FORMING APPARATUS

BACKGROUND OF THE INVENTION

1. Field of the Invention

The present invention relates to a sheet feeding device and an image forming apparatus and, more particularly, to the one in which sheets are separated and fed by blowing air to the sheets.

2. Description of the Related Art

Conventionally, image forming apparatuses such as printers and copying machines are provided with a sheet feeding device of feeding sheets one by one from a sheet containing portion in which a plurality of sheets are contained. There is such a sheet feeding device of air sheet feeding type in which air is blown to the end portion of a sheet stack contained in a sheet containing portion to blow up several sheets, and only one sheet is sucked to a sucking and conveying belt disposed thereabove to be conveyed. For example, a sheet feeding device of this type is disclosed in Japanese Patent Application Laid-Open No. H07-196187.

FIG. 14 illustrates one example of a sheet feeding device of such air sheet feeding type. As illustrated in FIG. 14, a tray 12 on which sheets S are stacked is disposed so as to be capable of being lifted or lowered in a storage 11, being a sheet containing portion in which a plurality of sheets S is contained. Moreover, there are provided above this storage 11, a conveying portion 50A that sucks and conveys sheets S, and an air blowing portion 30 for blowing air to the end portion of a sheet stack on the tray to cause several sheets S to blow up, as well as to separate them from one another.

Herein, the conveying portion 50A is provided with a sucking and conveying belt 21 that is passed over belt driving rollers 41, and sucks sheets S to convey them rightward in FIG. 14, and a suction fan 36 generating a negative pressure for causing a sheet S to be sucked to the sucking and conveying belt 21. Furthermore, there is provided a suction duct 51 disposed inside the sucking and conveying belt 21, and acting to suck in air through suction holes formed in the suction belt 21. In addition, to make ON/OFF of sucking operation made by the suction fan 36, there is provided a suction shutter 37 disposed between the suction fan 36 and the suction duct 51.

Furthermore, the air blowing portion 30 is provided with a loosening nozzle 33 and a separation nozzle 34 for blowing air to the upper portion of a contained sheet stack, a separation fan 31, and a separation duct 32 supplying air from the separation fan 31 to each of the nozzles 33 and 34.

Further, a part of air having been sucked in the direction indicated by the arrows C with the separation fan 31 is passed through the separation duct 32 to be blown in the direction indicated by the arrows D with the loosening nozzle 33, and acts to blow up several upper sheets of the sheet stack supported on the tray 12. Moreover, other air is blown in the direction indicated by the arrows E with the separation nozzle 34, and acts to separate only the uppermost sheet one by one out of the several sheets blown up with the loosening nozzle 33 to be sucked to the sucking and conveying belt 21.

Incidentally, to make a sheet S to be sucked to the sucking and conveying belt 21 like this, an uppermost sheet Sa of the sheet stack contained in the storage 11 needs to be maintained in a predetermined sheet feeding position capable of being sucked to the suction belt 21.

Accordingly, conventionally there has been provided a sheet surface detecting mechanism formed of a sheet surface detecting sensor and sensor flag acting to detect positions of the uppermost sheet Sa. In this sheet surface detecting mechanism, lifting and lowering of a tray 12 supporting sheets are controlled by detecting the displacement of the sensor flag with the sheet surface detecting sensor. Further, conventionally, the sheet surface detecting sensor and the sensor flag of such a sheet surface detecting mechanism are disposed in an internal part of the suction duct 51. For example, one example of this construction is described in Japanese Patent Application Laid-Open No. 2003-95467.

However, when a sheet surface detecting sensor and the like are disposed in the suction duct 51 like this, there has to be a space for containing the sheet surface detecting sensor and the like in the suction duct 51. Moreover, when such containing space is formed, a suction duct 51 becomes large, and thus the whole of an image forming apparatus comes to be larger accordingly.

Further, the capacity of a suction duct 51 comes to be larger. Herein, since the capacity of the suction duct 51 is closely related to the power of a suction fan 36, a larger capacity of the suction duct 51 leads to upsizing of the suction fan 36, resulting in waste of energy consumption or higher costs. In addition, although the suction duct 51 is required to have a high air-tightness, it is significantly difficult that a sheet surface detecting mechanism is smoothly operated, as well as electrical parts such as sensors of the sheet surface detecting mechanism are disposed while keeping air-tightness.

For these reasons, to achieve downsizing of an apparatus or maintain a stable performance, as illustrated e.g., in FIG. 15, it is practical that a sheet surface detecting mechanism 50B is disposed outside a suction duct 51. Now, the sheet surface detecting mechanism 50B disposed outside the suction duct 51 like this, and functioning to detect the upper surface of sheets S stacked on a tray 12, is described.

This sheet surface detecting mechanism 50B is provided with a sheet surface detecting sensor flag 52 pivotally supported about a support shaft 53, and contacted with the upper surface of sheets S, and a first sheet surface sensor 54 and a second sheet surface sensor 55 made to be ON/OFF by turning of the sheet surface detecting sensor flag 52.

Herein, the sheet surface detecting sensor flag 52 is provided with a contact portion 52A in contact with the upper surface of the uppermost sheet Sa, a first detecting portion 52B shading a light-receiving portion of the first sheet surface sensor 54, and a second detecting portion 52C shading a light-receiving portion of the second sheet surface sensor 55.

In the sheet surface detecting mechanism 50B of such construction, when the tray 12 is lifted for feeding sheets S, the contact portion 52A of the sheet surface detecting sensor flag 52 is in contact with the upper surface of the uppermost sheet Sa, and thereafter the sheet surface detecting sensor flag 52 is pivoted accompanied by the rise of the tray 12. Then, when the sheet surface detecting sensor flag 52 is pivoted like this, the first detecting portion 52B and the second detecting portion 52C make ON/OFF of the first sheet surface sensor 54 and the second sheet surface sensor 55 as appropriate respectively.

Furthermore, a controller acting to control lifting and lowering of the tray 12 makes lifting and lowering of the tray 12 based on ON/OFF of these first and second sheet surface sensors 54 and 55 to maintain the uppermost sheet Sa in a predetermined sheet feeding position.

However, in conventional sheet feeding devices and image forming apparatuses provided with such a sheet surface detecting mechanism, for example, in the case of sheets which end portions of the downstream side in a sheet conveying direction are curled upward, when air is blown to the sheets from the loosening nozzle 33, they will be in such a blown-up state as illustrated in FIG. 16. Herein, in this state, while the sheet surface height of the uppermost sheet Sa in a position where the contact portion 52A of the sheet surface detecting sensor flag 52 is in contact, is optimum (for example, SL), the downstream side end portions of sheets S are contacted with the sucking and conveying belt 21.

Then, in such a state, when the uppermost sheet Sa is sucked to the sucking and conveying belt 21, as well as a separating air is blown from the separation nozzle, the separating air indicated by the arrow is interrupted with curls of the sheets not to be capable of smoothly coming in between the sheets. Thus, sheets cannot be separated (loosened) sufficiently from one another.

Consequently, the next sheet Sb or the subsequent plural sheets of a sheet stack are conveyed erroneously in association with the uppermost sheet Sa, thus leading to a problem of the occurrence of double feed of sheets or jamming (sheet jamming).

That is, in the case where a sheet surface detecting mechanism 50B is disposed outside of the suction duct 51 for the purpose of preventing upsizing of apparatuses, for example, in case of sheets curled upward, the distance of sheets with respect to the sucking and conveying belt 21 cannot be exactly recognized. As a result, feeding failures such as double feed of sheets or jamming will occur.

SUMMARY OF THE INVENTION

Thus, the present invention has been made in view of such existing conditions, and has an object of providing sheet feeding devices and image forming apparatuses capable of reliably feeding sheets without upsizing.

The present invention is to provide an image forming apparatus, which forms an image on a sheet fed from a sheet feeding device in an image forming portion, the sheet feeding device comprising: a tray which supports sheets; an air blowing portion which blows air to an end portion of the sheets supported by the tray; a conveying portion which sucks and conveys the sheet blown up with air blown by the air blowing portion; and a sheet surface detecting mechanism, which detects an upper surface of a sheet blown up, the sheet surface detecting mechanism including: a sensor portion disposed in a position spaced apart from the conveying portion to an upstream side in a sheet conveying direction; a sensor flag which turns the sensor portion ON and OFF; and a sheet surface detecting member connected to the sensor flag, extending from a side on which the sensor portion is disposed to under the conveying portion and toward a downstream side in the sheet conveying direction, and being contactable with a sheet being blown up.

DESCRIPTION OF THE PREFERRED EMBODIMENTS

Figure 1:
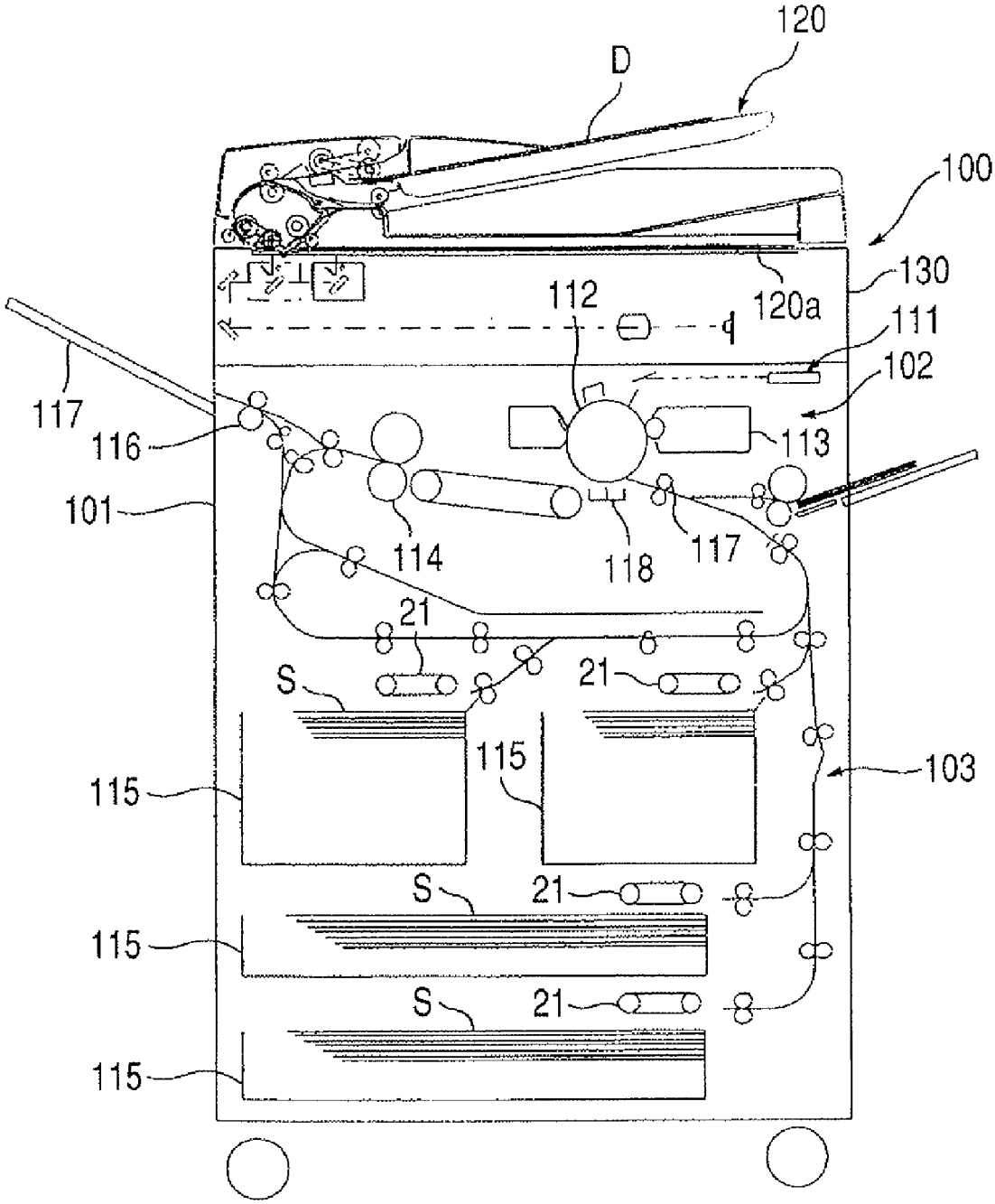
FIG. 1 is a view illustrating a schematic construction of a printer, being one example of an image forming apparatus provided with a sheet feeding device according to an embodiment of the present invention.

Hereinafter, a best mode for carrying out the present invention will be described in detail referring to the drawings.

FIG. 1 is a view illustrating a schematic construction of a printer, being one example of an image forming apparatus provided with a sheet feeding device according to an embodiment of the present invention.

In FIG. 1, at the upper portion of a printer body 101 of a printer 100, there is provided a image reading portion 130 of a document D placed on a platen glass 120*a* acting as a document table of an automatic document feeding device 120. Further, there are provided under the image reading portion 130 an image forming portion 102 and a sheet feeding device 103 feeding sheets S to the image forming portion 102.

Herein, there are provided at the image forming portion 102 a photosensitive drum 112, a developing device 113, and a laser scanner unit 111. In addition, there are provided at the sheet feeding device 103 a plurality of sheet containing portions 115 containing sheets S such as OHT to be removable with respect to the apparatus body 101 and sucking and conveying belts 21 feeding sheets S contained in respective sheet containing portions 115.

Now, image forming operations of the printer 100 of such construction will be described.

When an image read signal is output to the image reading portion 130 from a controller (not shown) provided at the apparatus body 101, an image is read with the image reading portion 130. Thereafter, laser beams in response to this electrical signal are irradiated onto the photosensitive drum 112 from the laser scanner unit 111.

On that occasion, the photosensitive drum 112 has preliminarily been charged, and is formed with an electrostatic latent image by irradiation of beams, and subsequently this electrostatic latent image is developed with the developing device 113, thereby forming a toner image on the photosensitive drum.

On the other hand, when a sheet feed signal is output from the controller to the sheet feeding device 103, a sheet S is fed from the sheet containing portion 115. Thereafter, the sheet S having been fed is conveyed to a transfer portion that is formed of the photosensitive drum 112 and the transfer charger 118 in synchronization with a toner image formed on the photosensitive drum with a registration roller.

Then, the sheet thus conveyed to the transfer portion is transferred with a toner image, and thereafter conveyed to a fixing portion 114. Further thereafter, the sheet is heated and pressurized at the fixing portion 114, whereby a transfer image not having been fixed will be permanently fixed to the sheet S. Subsequently, the sheet on which the image thus fixed is discharged to a sheet discharge tray 117 from the apparatus body 101 with a discharge roller 116.

Figure 2:
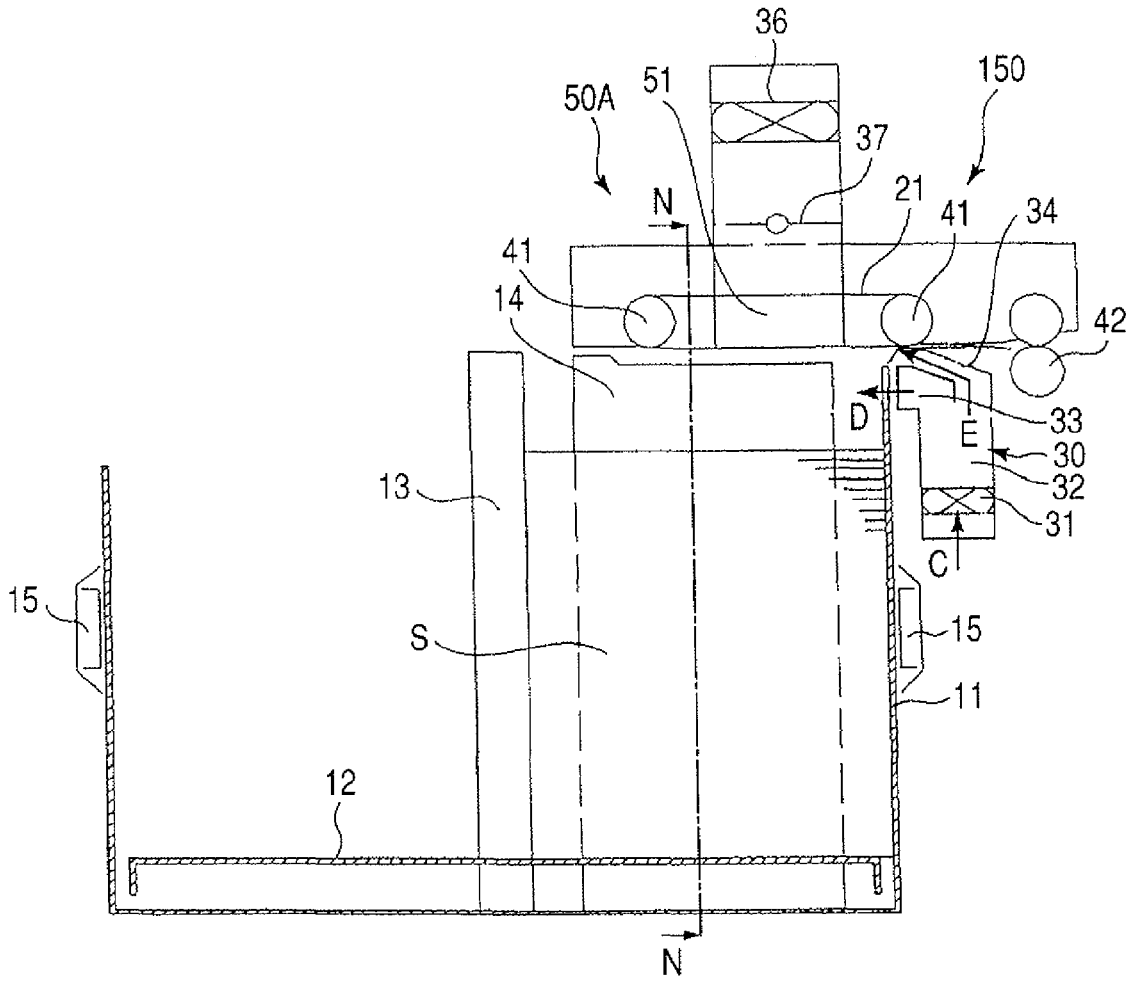
FIG. 2 is a view illustrating construction of the above-mentioned sheet feeding device.
Figure 14:
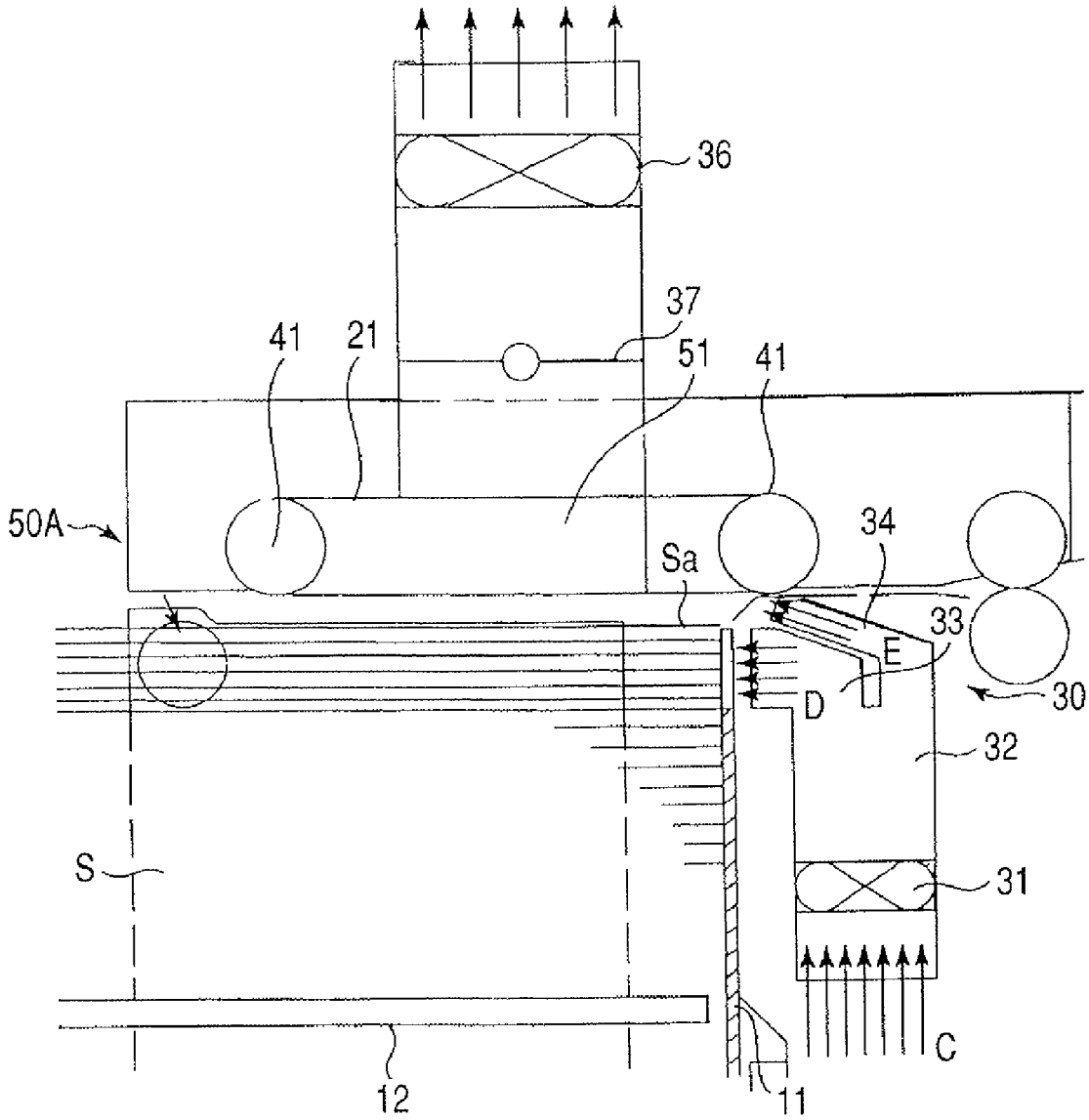
FIG. 14 is a view for illustrating operations of a conventional sheet feeding device.
Figure 15:
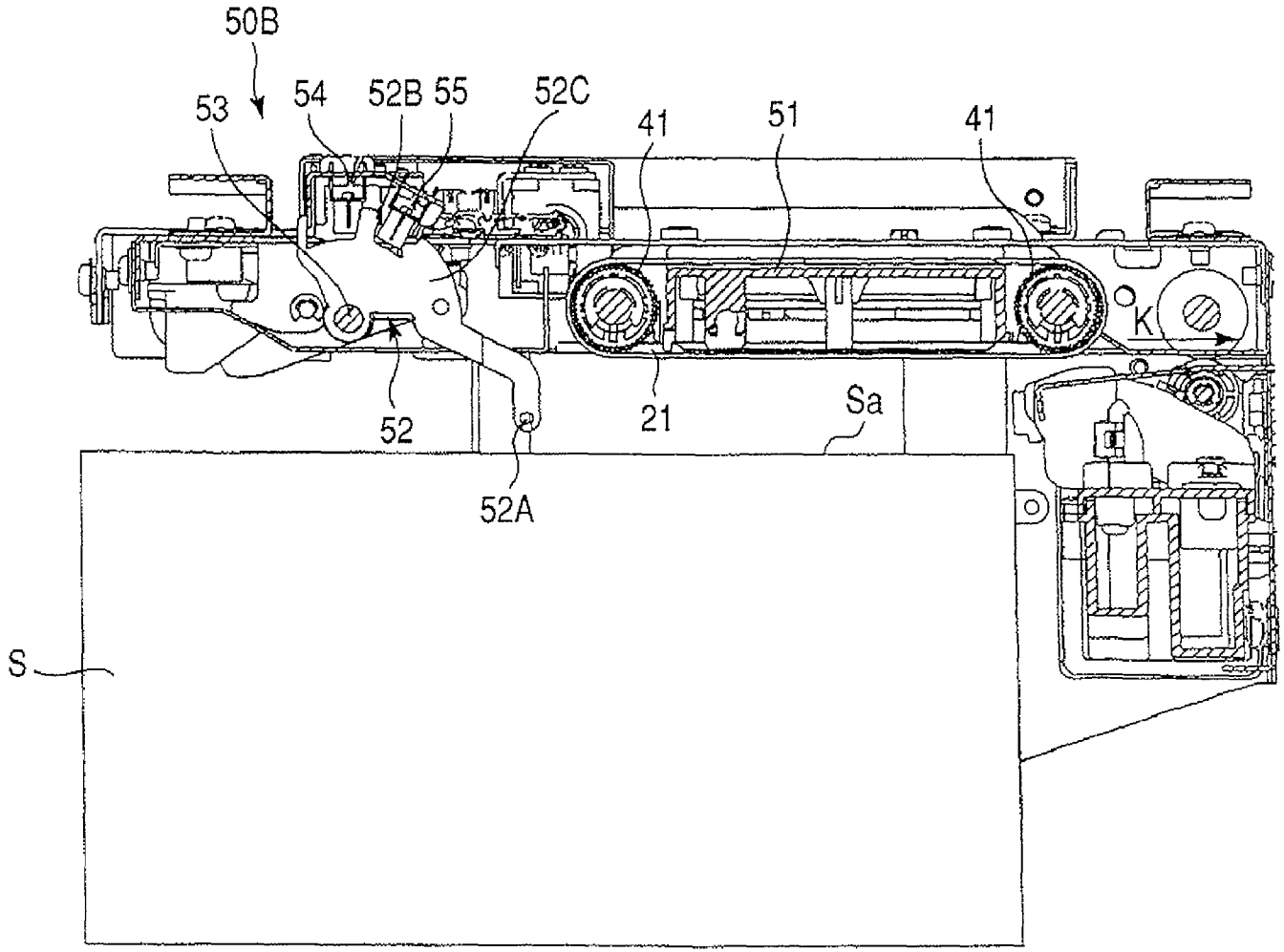
FIG. 15 is a view for illustrating a sheet surface detecting mechanism of the conventional sheet feeding device.
Figure 16:
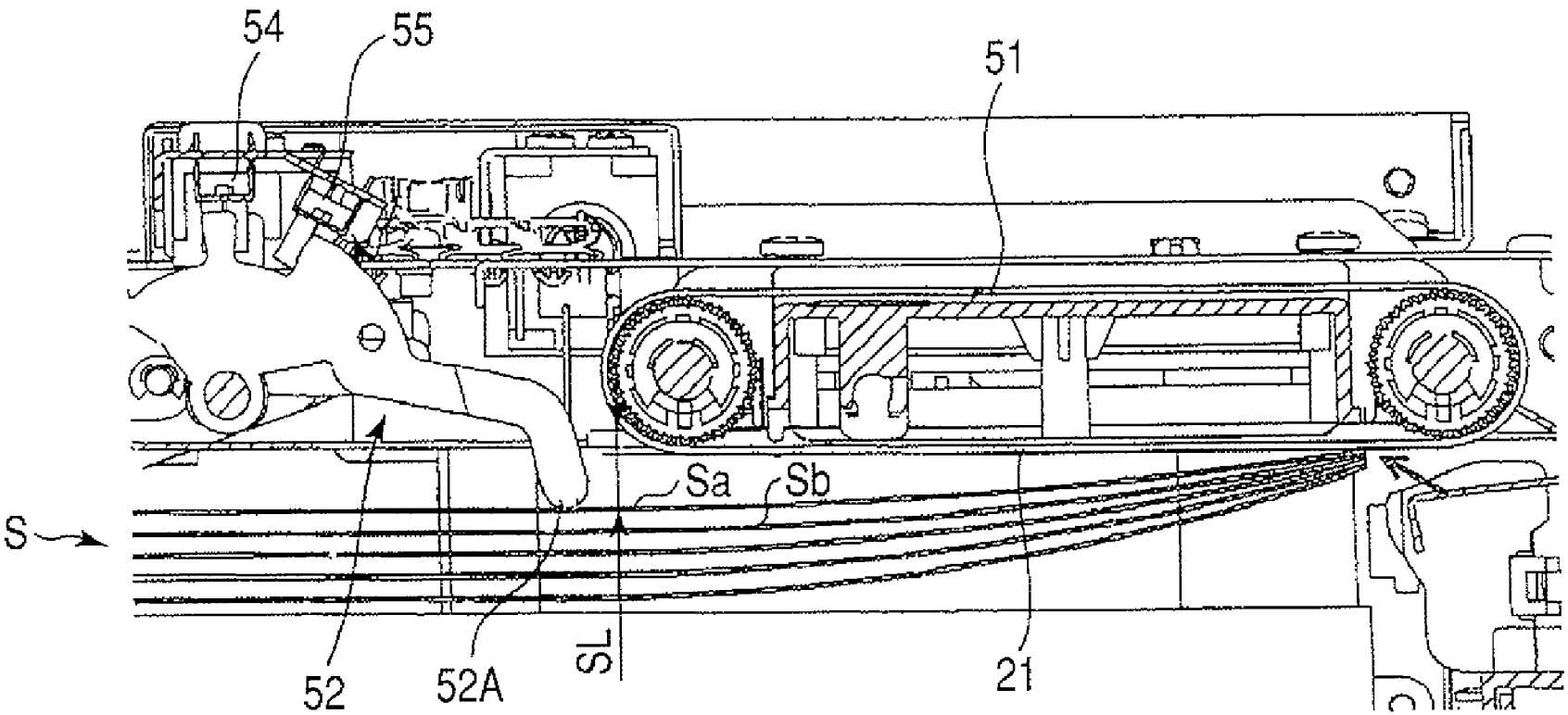
FIG. 16 is a view illustrating the state in which air is blown to curled sheets in the conventional sheet feeding device.

FIG. 2 is a view illustrating construction of the sheet feeding device 103. In FIG. 2, like reference numerals refer to the same or corresponding parts to those of FIG. 14 having been described already.

There are provided at a storage 11 a tray 12, a tray driving unit DT (illustrated in FIG. 13) such as a motor for lifting and lowering the tray 12, a tailing edge regulating plate 13 regulating the upstream side in a feeding direction (rear side) of sheets S, and a side edge regulating plate 14 regulating positions in a width direction perpendicular to the feeding direction of sheets S. In addition, the trailing edge regulating plate 13 and the side edge regulating plate 14 are constructed so as to be changed in any position depending on the size of sheets to be contained. Further, the storage 11 can be pulled out from the printer body 101 with slide rails 15.

Moreover, there is disposed on the top of this storage 11 a sheet feeding mechanism of air sheet feeding type (hereinafter referred to as an air sheet feeding mechanism 150) acting to separate and feed sheets one by one. This air sheet feeding mechanism 150 is provided with a conveying portion 50A for sucking and conveying sheets S stacked (supported) on the tray 12 and an air blowing portion 30 for blowing up the upper portion of a sheet stack on the tray, as well as for separating the sheets S from one another.

Herein, the conveying portion 50A is provided with a sucking and conveying belt 21 passed over belt driving rollers 41 that are driven by a belt driving unit DB (illustrated in FIG. 13) such as a motor, as well as sucking and conveying sheets S to the right in FIG. 2. Furthermore, the conveying portion 50A is provided with a suction fan 36 generating a negative pressure for causing the uppermost sheet S to be sucked to the sucking and conveying belt 21. Further, the conveying portion 50A is provided with a suction duct 51 disposed inside the sucking and conveying belt 21, and acting to suck in air via suction holes 21*a* illustrated in the below-described FIGS. 11A and 11B which suction holes 21*a* are formed in the suction belt 21.

Furthermore, there is provided a suction shutter 37 disposed between the suction fan 36 and the suction duct 51, and switching ON and OFF the sucking operation of the sucking and conveying belt 21. Moreover, according to this embodiment, a plurality of sucking and conveying belts 21 are disposed at predetermined spaced intervals in a width direction as illustrated in the below-described FIGS. 11A and 11B.

Moreover, an air blowing portion 30 is provided with a loosening nozzle 33 and separation nozzle 34 for blowing air to the upper portion of contained sheets S, a separation fan 31, and a separation duct 32 supplying air from the separation fan 31 to each nozzle 33 or 34.

In addition, a part of air having been sucked in the direction indicated by the arrow C with the separation fan 31 is passed through the separation duct 32 and blown in the direction indicated by the arrows D with the loosening nozzle 33 to cause several sheets of the upper portion of sheets S supported on the tray 12 to blow up. Furthermore, the other air is blown in the direction indicated by the arrow E with the separation nozzle 34, and acts to separate the sheets having been blown up with the loosening nozzle 33 from one another to be sucked to the sucking and conveying belt 21.

Now, sheet feeding operations of the sheet feeding device 103 (air sheet feeding mechanism 150) of such construction will be described.

Figure 3:
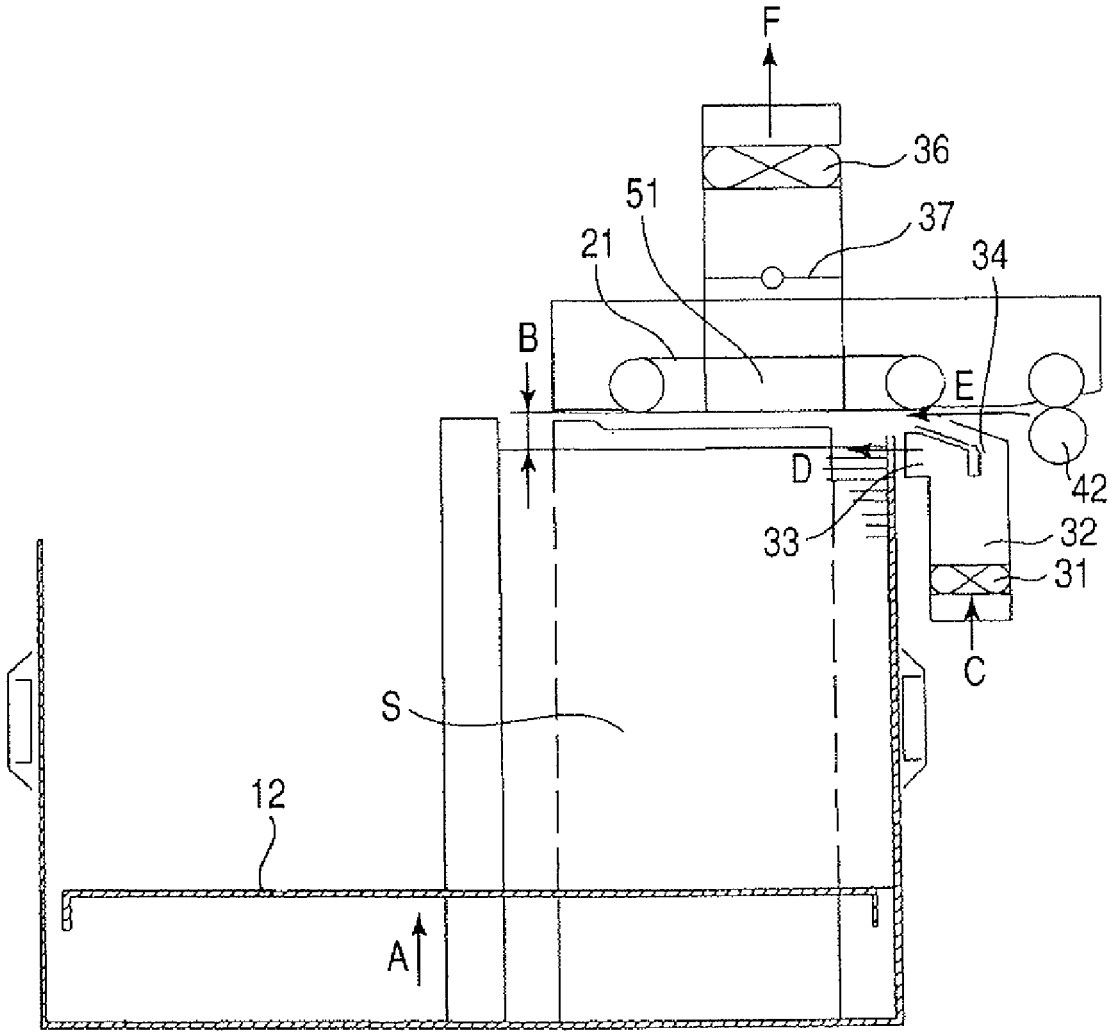
FIG. 3 is a first view for illustrating sheet feeding operation of the above-mentioned sheet feeding device.

First, when a user pulls out the storage 11 to set sheets S therein, and thereafter pushes the storage in a predetermined position as illustrated in FIG. 2, first the tray 12 begins to rise in the direction indicated by the arrow A by a tray driving unit DT as illustrated in FIG. 3. Then, when the tray 12 has reached the position capable of feeding sheets where the distance with respect to the sucking and conveying belt 21 is B, a controller 1000 controlling the sheet feeding device (illustrated in FIG. 13) causes the tray 12 to stop in this position. Thereafter, the tray 12 stands ready for a sheet feeding signal with which feeding is started.

Subsequently, when detecting the sheet feeding signal, the controller 1000 brings the separation fan 31 in operation. Thus, air is sucked in the direction indicated by the arrow C, and blown to a sheet stack in respective directions indicated by the arrows D and E from the loosening nozzle 33 and the separation nozzle 34 via the separation duct 32. Whereby, several sheets at the upper portion of the sheet stack are blown up. Furthermore, the controller 1000 brings the suction fan 36 in operation, and thus air is discharged in the direction indicated by the arrow F in FIG. 3. At that time, a suction shutter 37 is still closed.

Figure 4:
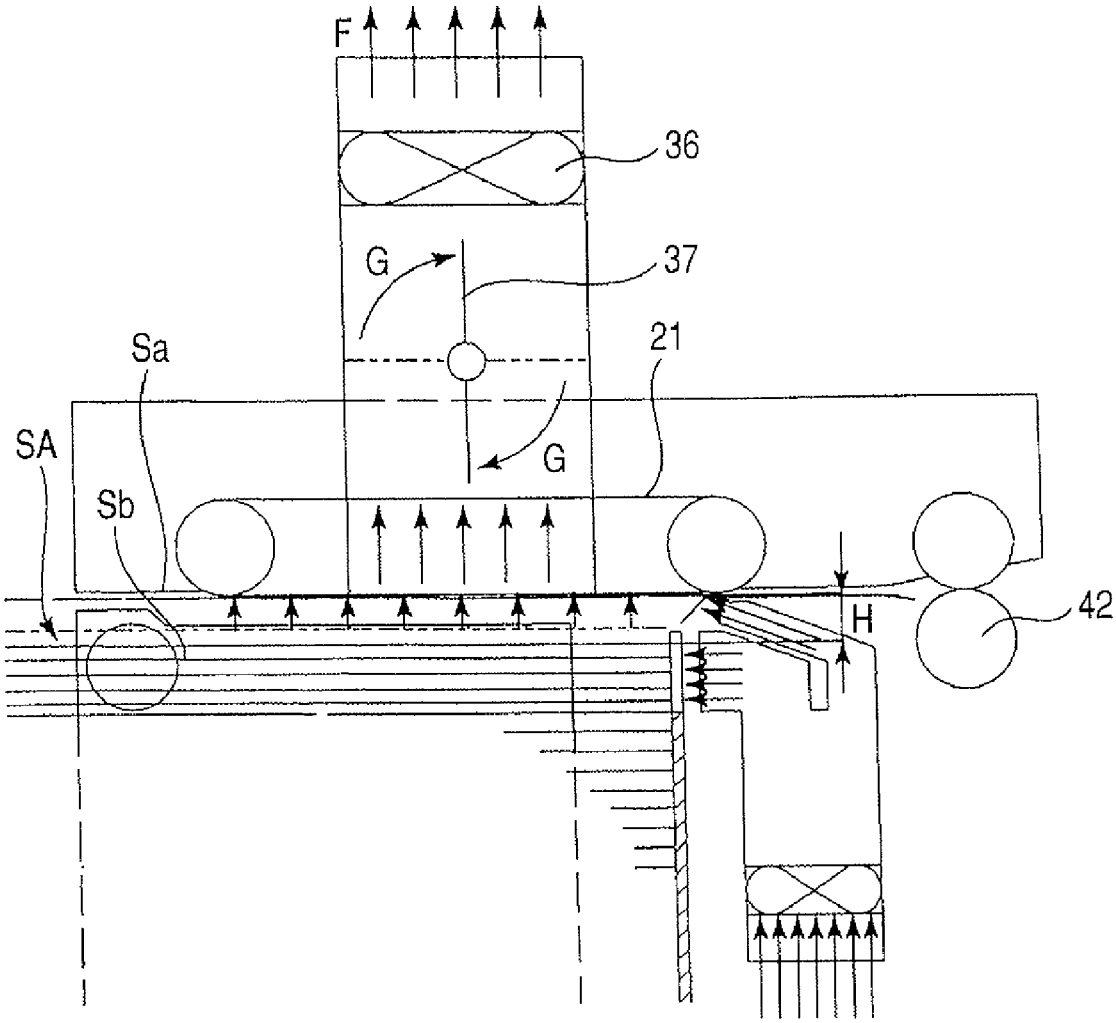
FIG. 4 is a second view for illustrating sheet feeding operation of the above-mentioned sheet feeding device.

Then, when a predetermined time period has passed since detection of the feeding signal, and the upper portion of sheets SA have been blown up with stability as illustrated in FIG. 4, the controller 1000 causes the suction shutter 37 to rotate in the direction indicated by the arrows G to generate a suction force in the direction indicated by the arrows H through suction holes formed in the sucking and conveying belt 21. Thus, with this suction force and a separating air from the separation nozzle 34, only the uppermost sheet Sa is sucked to the sucking and conveying belt 21.

Figure 5:
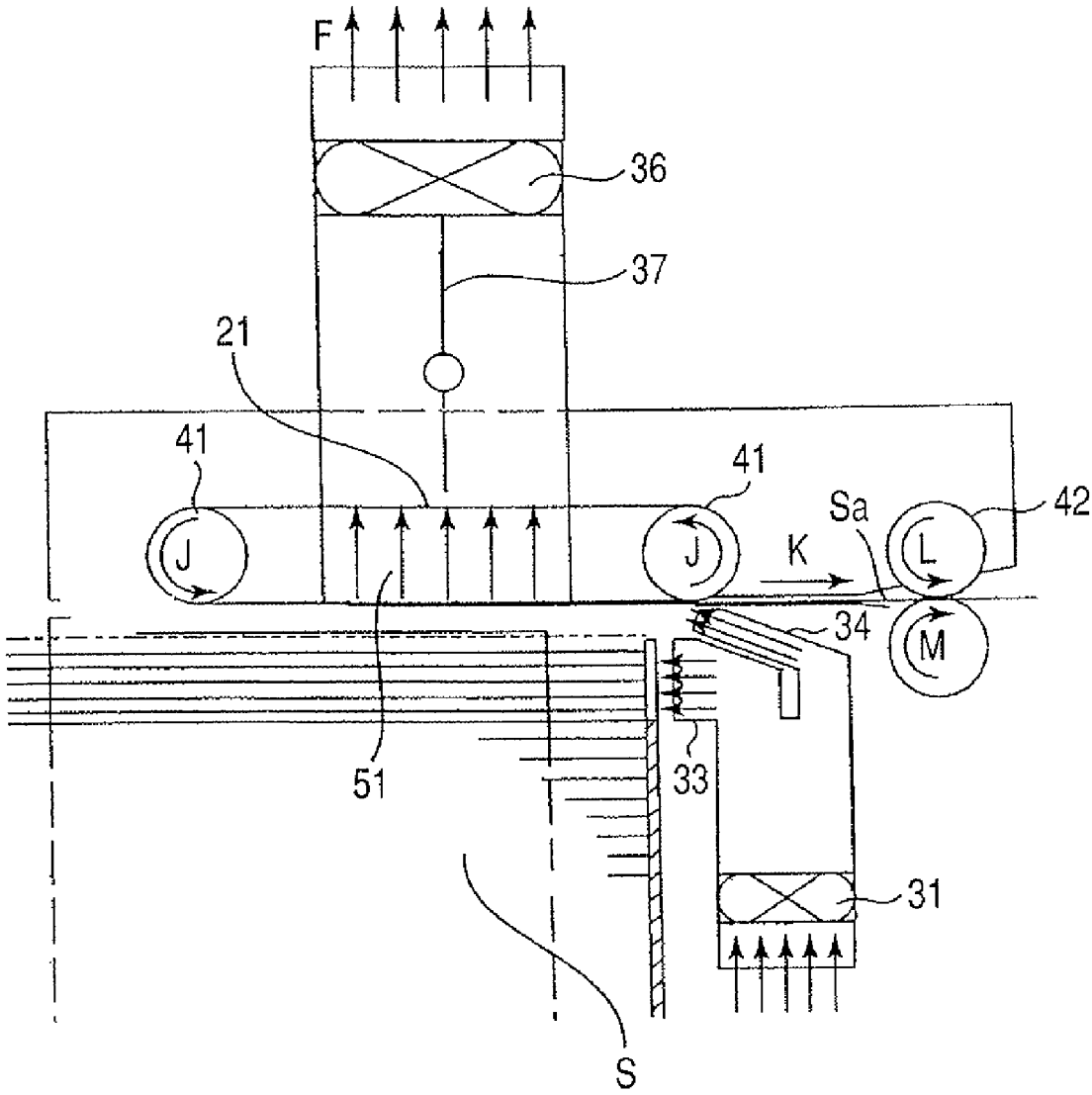
FIG. 5 is a third view for illustrating sheet feeding operation of the above-mentioned sheet feeding device.

Subsequently, belt driving rollers 41 are brought in rotation in the direction indicated by the arrows J by the belt driving unit DB in FIG. 5, whereby the uppermost sheet Sa is conveyed in the direction indicated by the arrow K in the state of being sucked to the sucking and conveying belt 21. Thereafter, by rotation in the directions indicated by the arrows L and M of a pair of drawing rollers 42 disposed on the downstream side in the sheet conveying direction, a sheet is fed toward the image forming portion.

Incidentally, to cause sheets S to be sucked to the sucking and conveying belt 21 like this, the uppermost sheet Sa of a sheet stack, which is contained in the storage 11, needs to be maintained in a predetermined sheet feeding position where suction with the suction belt 21 can be made. Therefore, there is provided a sheet surface detecting mechanism 49 for controlling positions of the uppermost sheet Sa of the sheet stack.

Now, such the sheet surface detecting mechanism 49 will be described.

Figure 6:
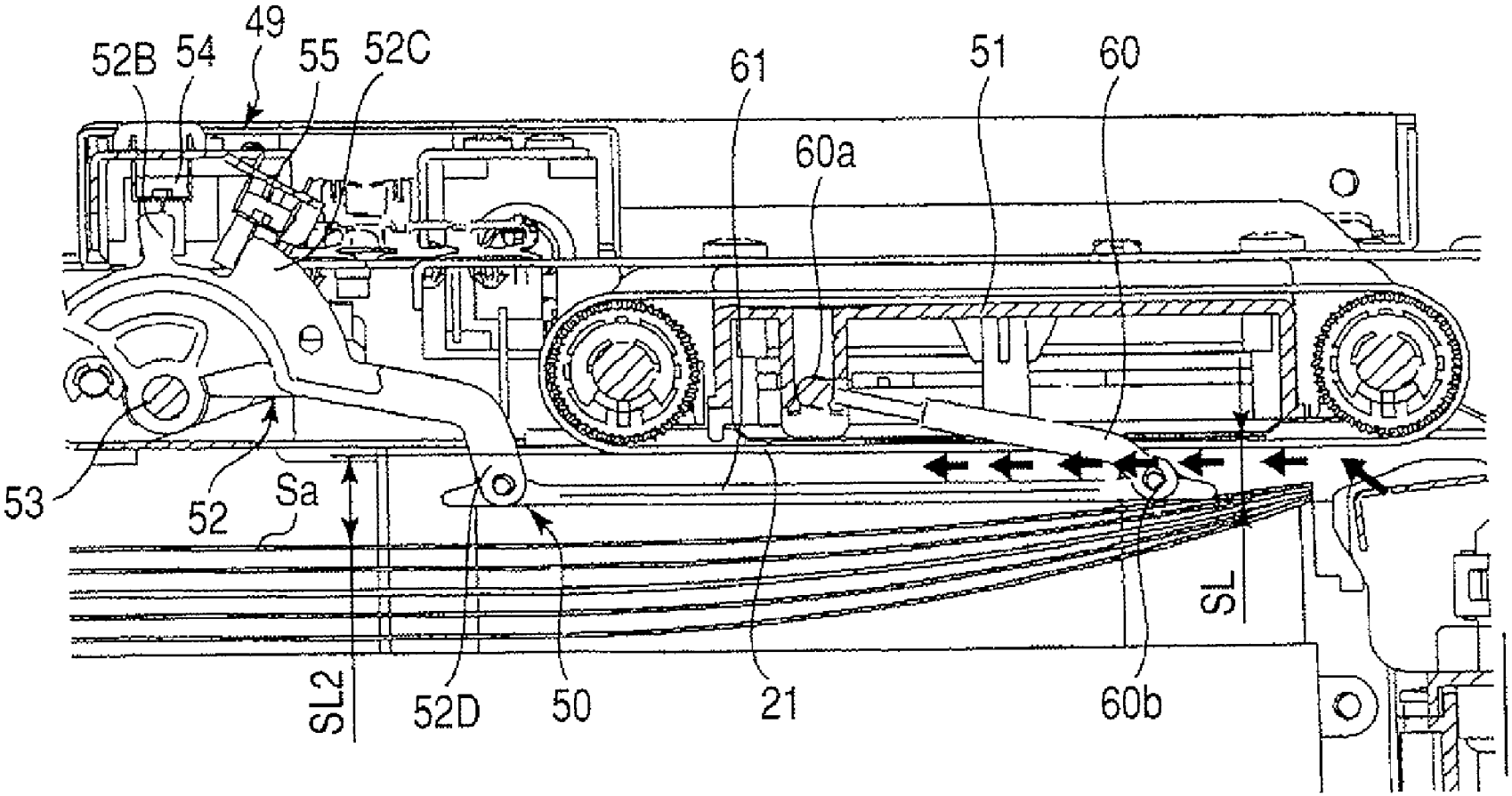
FIG. 6 is a view for illustrating construction of a sheet surface detecting mechanism provided in the above-mentioned sheet feeding device.

This sheet surface detecting mechanism 49, as illustrated in FIG. 6, is provided with a sheet surface detecting sensor flag 52, sensor portions (a first sheet surface sensor 54 acting as a first sensor and a second sheet surface sensor 55 acting as a second sensor), and a sensor flag mechanism 50. Furthermore, the first and second sheet surface sensors 54 and 55 are disposed in a position spaced apart to the upstream side in a sheet feeding direction from the sucking and conveying region (region of a belt surface on the side of a sheet being sucked) of the sucking and conveying belt 21 of the conveying portion 50A.

Moreover, due to that the first and second sheet surface sensors 54 and 55 are disposed not in the suction duct 51 but in such a position like this, the above-described upsizing of the suction duct 51 can be prevented, and thus downsizing of a printer body 101 can be achieved.

Figure 7:
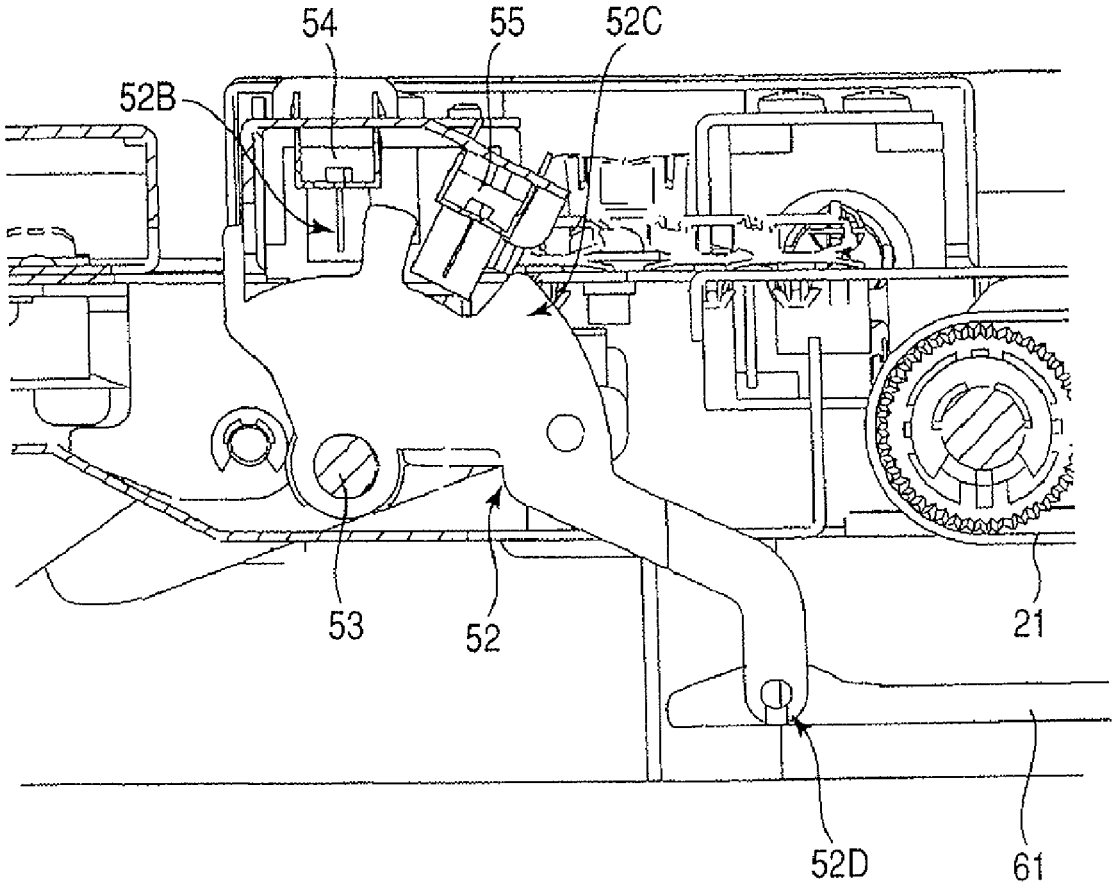
FIG. 7 is a view for illustrating construction of a sheet surface detecting sensor flag provided in the above-mentioned sheet surface detecting mechanism.

Herein, the sheet surface detecting sensor flag 52 is supported pivotally about a support shaft 53 as illustrated in FIG. 7. Furthermore, the sheet surface detecting sensor flag 52 is provided with a first detecting portion 52B shading the light-receiving portion of the first sheet surface sensor 54, a second detecting portion 52C shading the light-receiving portion of the second sheet surface sensor 55, and a support portion 52D pivotally supporting the below-described sheet surface detecting member 61.

In addition, the sensor flag mechanism 50 is provided with a support member 60 which one end 60*a* is pivotally held in an internal part of the suction duct 51 as illustrated in FIG. 6, and a sheet surface detecting member 61 supported with a pivotal end 60*b* of the support member 60 and a support portion 52D of the sheet surface detecting sensor flag 52.

Herein, this sheet surface detecting member 61 is located in parallel with sheets S stacked on the tray 12 under the sucking and conveying region of the conveying portion 50A, as well as in a manner of moving in the vertical direction. Furthermore, the support member 60, which is pivotally supported in the suction duct, protrudes toward the underside of the sucking and conveying region of the sucking and conveying belt 21 through a retracting hole 51H1 formed in a gap in a sheet width direction of a plurality of sucking and conveying belts 21 as illustrated in the below-described FIGS. 11A and 11B.

Moreover, these support member 60, sheet surface detecting sensor flag 52 and sheet surface detecting member 61 form a parallel link. Whereby, even if a sheet is in contact with any longitudinal position of the sheet surface detecting member 61, the sheet surface detecting member 61 can move up and down being maintained in the parallel state (horizontal state) while the sheet surface detecting sensor flag 52 being pivoted.

Now, sheet surface control operations based on detection of the sheet surface detecting mechanism 49 of such construction will be described.

Sheets contained in the storage 11 are lifted by the rise of the tray 12, and thus the upper surface of the uppermost sheet Sa is brought into contact with the sheet surface detecting member 61. Then, thereafter, when the tray 12 is lifted further, the sheet surface detecting member 61 is lifted. As this sheet surface detecting member 61 is lifted, the sheet surface detecting sensor flag 52 is pivoted about the support shaft 53 in the direction of the support portion 52D going upward.

Figure 8:
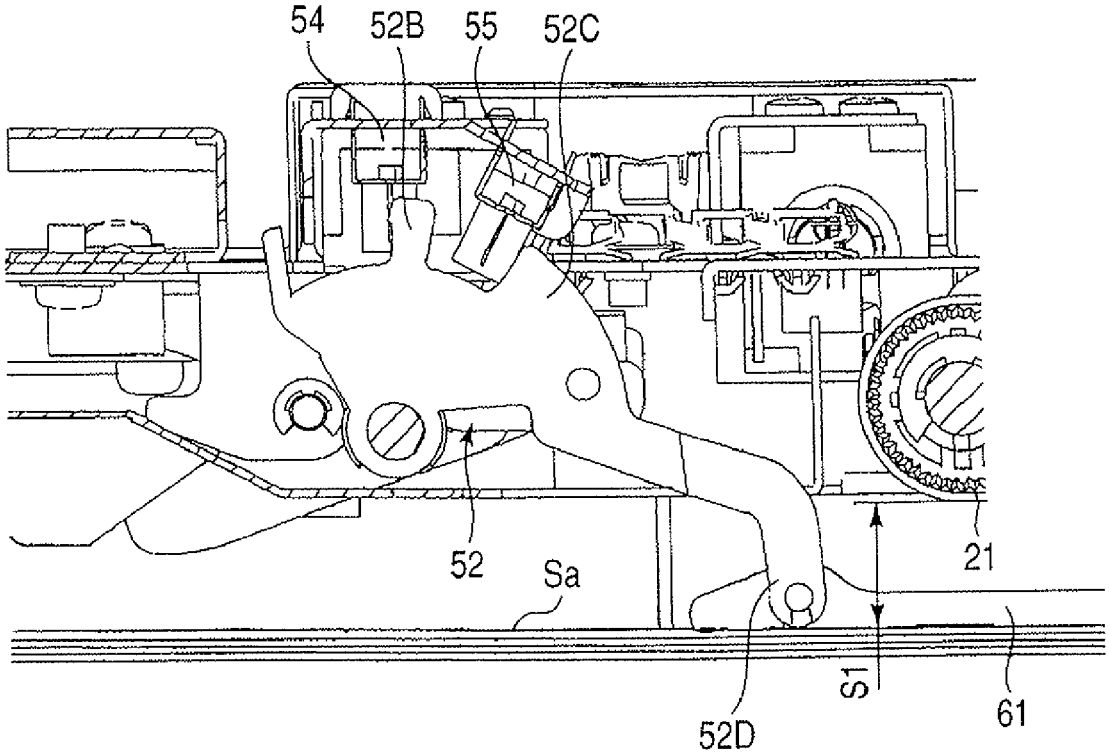
FIG. 8 is a first view for illustrating sheet surface control operation of the above-mentioned sheet feeding device.

Then, as illustrated in FIG. 8, when the distance between the upper surface of the uppermost sheet Sa having been lifted while the sheet surface detecting member 61 being lifted and the belt surface of the sucking and conveying belt 21 comes to be S1, the first sheet surface sensor 54 is shaded with the first detecting portion 52B of the sheet surface detecting sensor flag 52.

Whereby, the first sheet surface sensor 54 outputs ON signal. When the first sheet surface sensor 54 outputs ON signal like this, the controller 1000 stops the rise of the tray 12 based on this ON signal. Herein, letting this position the lower limit of the region of being blown up, thereafter, the controller 1000 starts blowing of air toward sheets with the air blowing portion 30 to blow up the sheets.

Subsequently, after the sheets have been blown up like this, the controller 1000 causes the tray 12 to rise with the tray driving unit DT. Further, the controller 1000, determining to be "too low" until ON signal of the second sheet surface sensor 55 is obtained, allows the tray 12 to rise until ON signal is obtained.

Figure 9:
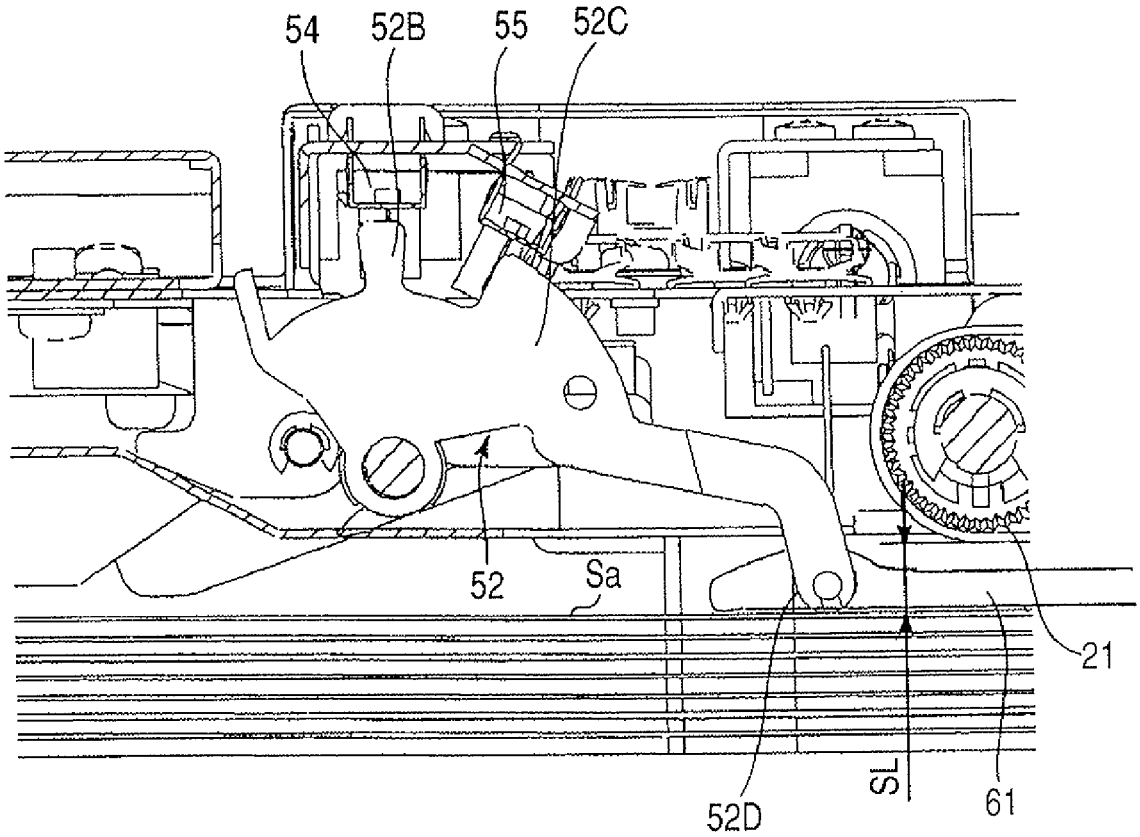
FIG. 9 is a second view for illustrating sheet surface control operation of the above-mentioned sheet feeding device.

Then, as illustrated in FIG. 9, when the distance between the belt surface of the sucking and conveying belt 21 and the upper surface of the uppermost sheet Sa comes to be SL, the second sheet surface sensor 55 is shaded with the second detecting portion 52C of the sheet surface detecting sensor flag 52. Whereby, the second sheet surface sensor 55 outputs ON signal. As above, when ON signal is output from both the first sheet surface sensor 54 and the second sheet surface sensor 55, the controller 1000 stops the rise of the tray 12.

Figure 10:
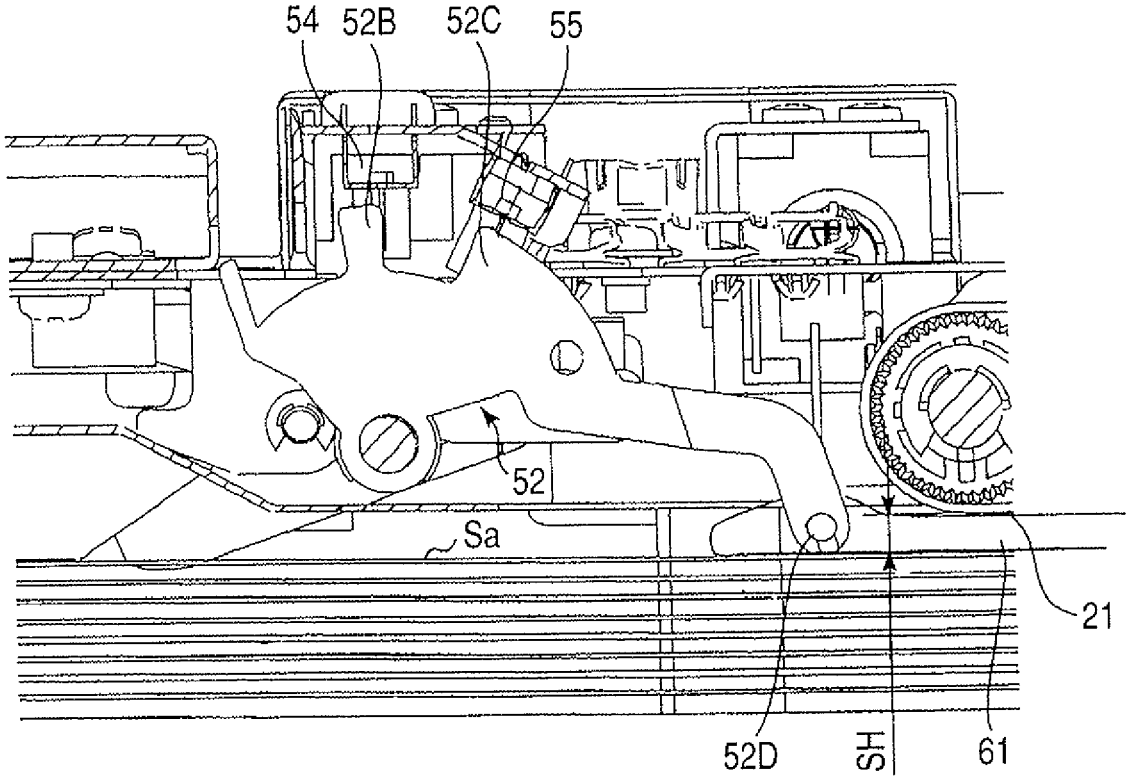
FIG. 10 is a third view for illustrating sheet surface control operation of the above-mentioned sheet feeding device.

Herein, this position is taken as the upper limit of the region being blown up. Furthermore, as illustrated in FIG. 10, there are some cases where the tray 12 is lifted exceeding this upper limit, and the distance between the belt surface of the sucking and conveying belt 21 and the upper surface of the uppermost sheet Sa comes to be SH. In this case, the first sheet surface sensor 54 is released from being shaded with the first detecting portion 52B of the sheet surface detecting sensor flag 52, whereby the first sheet surface sensor 54 comes to be OFF. In this case, determining to be "too high", thereafter the controller 1000 causes the tray 12 to be lowered until ON signal of the first sheet surface sensor 54 is obtained.

The following table provides a summary of a series of operations after air blowing has been started.

TABLE 1

| First sheet surface sensor 54 | Second sheet surface sensor 55 | Tray operation |
|---|---|---|
| ON | OFF | Lifting |
| ON | ON | Stop |
| OFF | ON | Lowering |

As above, according to this embodiment, the tray 12 is to be lifted and lowered based on signals of the first and second sheet surface sensors 54 and 55. Whereby, the controller 1000 can control the tray 12 in the state of air being blown so as to be maintained in a position where only the uppermost sheet Sa can be sucked to be separated and conveyed with the sucking and conveying belt 21. As a result, when sucking a sheet with the sucking and conveying belt 21, sheets S can be separated from one another to be singly fed toward the image forming portion, thus enabling sheets to be fed with stability.

In addition, due to that a sheet surface detecting member 61 extending to the upstream side of the sucking and conveying region is used, even when the first and second sheet surface sensors 54 and 55 are disposed in a position spaced apart from the sucking and conveying region of the sucking and conveying belt 21 of the conveying portion 50A.

Now, sheet surface detecting operations of the sheet surface detecting mechanism 49 of such construction when sheets which downstream side end portions in the sheet feeding direction are curled upward, are contained in a storage 11 will be described.

When such curled sheets are stacked on the tray 12, if the tray 12 is lifted, as illustrated in FIG. 6, the sheet surface detecting member 61 is brought into contact with the curled end of a sheet S, which is curled, on the downstream end portion side in the sheet feeding direction. Herein, when being in contact with the curled end of the sheet S like this, the sheet surface detecting member 61 is vertically displaced in parallel, and the sheet surface detecting sensor flag 52 is pivoted accompanied thereby. Whereby, as described above, the first sheet surface sensor 54 and the second sheet surface sensor 55 are turned ON/OFF as appropriate, to make a sheet surface control as described already.

As a result, lifting and lowering of the tray 12 is controlled so as to obtain an optimum height (optimum distance between the sucking and conveying belt 21 and the sheet upper surface) SL in a position where the curled end of a sheet S and the sheet surface detecting member 61 are in contact. That is, by using the sheet surface detecting member 61 extended to the upstream side in the sucking and conveying region, even in the case of a curled sheet S, the tray 12 can be controlled to be in such a position that only the uppermost sheet Sa can be separated and conveyed.

Herein, when the upper surface of a sheet is controlled to be at an optimum height, a gap is made between the sheet end portion and the belt, and thus a separating air indicated by the arrows will smoothly come in this gap. Therefore, in this state, as illustrated in the already-described FIG. 4, when the uppermost sheet Sa is sucked, a separating air indicated by the arrows will smoothly come in between the sucked sheet Sa and the next sheet Sb. Whereby, sheets are reliably separated from one another with the separating air, thus enabling to prevent the occurrence of double feed or jamming of sheets.

Furthermore, when the uppermost sheet Sa is sucked like this, the sensor flag mechanism 50 is pushed with the sheet Sa to be sucked, and is retracted in the suction duct 51 so as not to prevent conveying of sheets. Now, such retracting operation of the sensor flag mechanism 50 will be described.

Figure 11A:
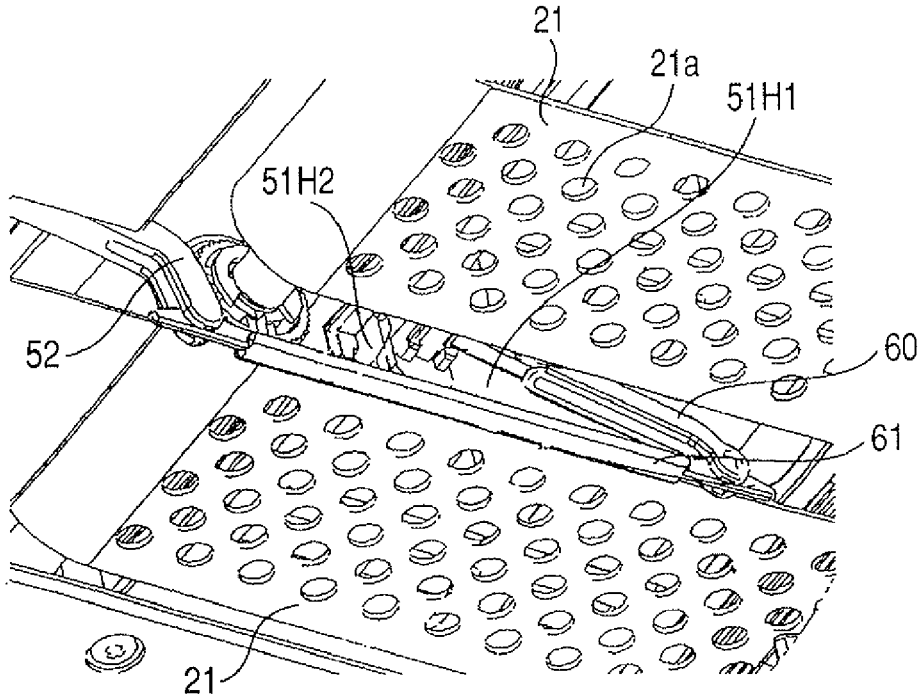
FIGS. 11A and 11B are views of the above-mentioned sheet surface detecting mechanism taken from diagonally below a sucking and conveying belt.
Figure 11B:
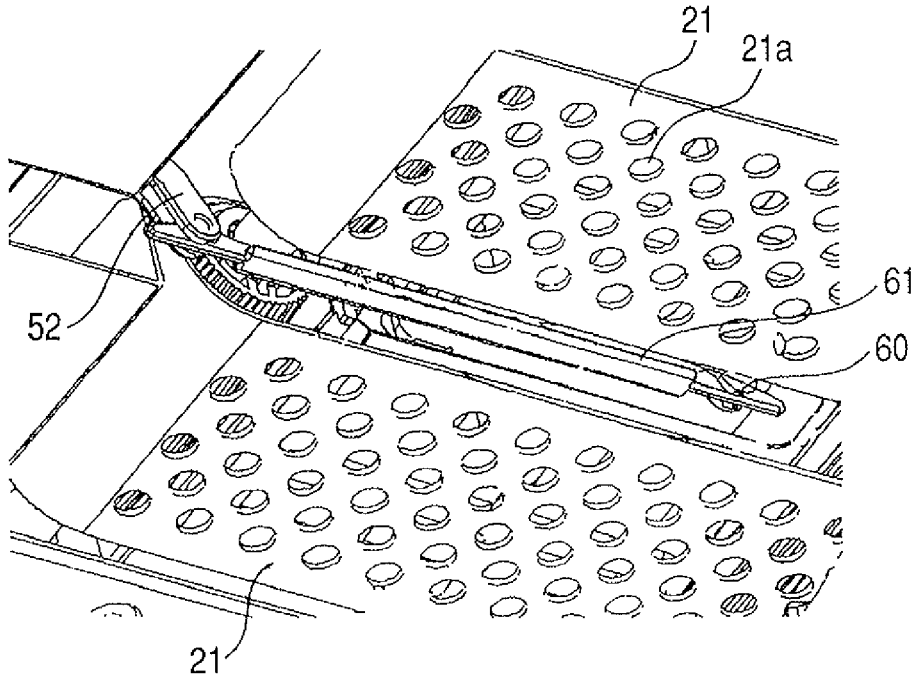

FIGS. 11A and 11B are views of the sheet surface detecting mechanism 49 taken from diagonally below the sucking and conveying belt 21. As illustrated in FIGS. 11A and 11B, there is formed in the suction duct 51 a first retracting hole 51H1, being an opening for causing the support member 60 to pivotally protrude in the vertical direction. Further, there is formed a second retracting hole 51H2 for housing the sensor flag mechanism 50 along with the first retracting hole 51H1 when the uppermost sheet is sucked to the sucking and conveying belt 21.

Herein, the first retracting hole 51H1 is a hole formed in the suction duct 51 in parallel with the sucking surface (face to which a sheet is sucked) between a plurality of sucking and conveying belts 21. The second retracting hole 51H2 is a hole formed along the longitudinal wall of the suction duct 51.

Figure 12:
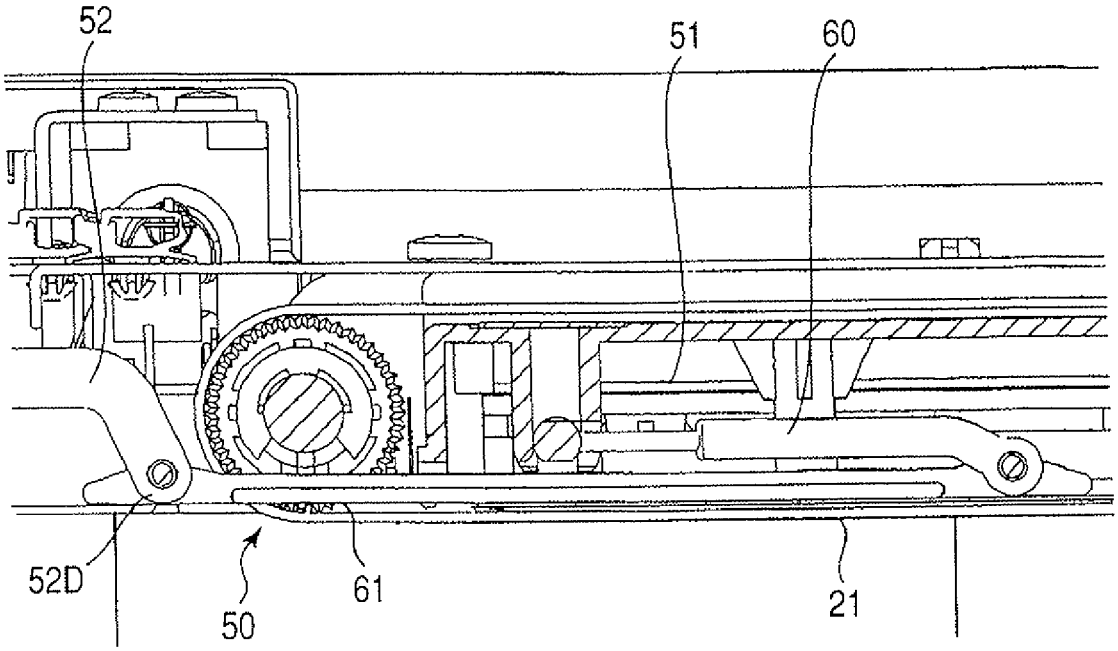
FIG. 12 is a view illustrating the state in which a sensor flag mechanism provided in the above-mentioned sheet surface detecting mechanism is housed in a suction duct.

Thus, when the uppermost sheet is sucked by the sucking and conveying belt 21, the sensor flag mechanism 50 is pushed by this sucked sheet to be retracted upward, and the sheet surface detecting member 61 is housed through the first and second retracting holes 51H1 and 51H2 as illustrated in FIG. 12. Whereby, the sensor flag mechanism 50 (sheet surface detecting member 61 thereof) can be prevented from protruding downward from the sucking surface of the sucking and conveying belt 21. Moreover, the first and second retracting holes 51H1 and 51H2 can be closed by the sensor flag mechanism 50.

In addition, since the first retracting hole 51H1 is a hole formed in parallel with the sucking and conveying belt 21, the first retracting hole 51H1 is covered with the uppermost sheet the sucking and conveying belt 21 sucks, a suction air is hardly leaked from this hole 51H1. Furthermore, although the second retracting hole 51H2 is a hole formed in a direction perpendicular to the sucking surface of the sucking and conveying belt 21, since the second retracting hole 51H2 is closed with the sheet surface detecting member 61 when the sensor flag mechanism 50 is housed, a suction air is hardly leaked as well.

Due to that the first and second retracting holes 51H1 and 51H2 are closed by the sheet surface detecting member 61 when a sheet is sucked in such a manner, even if the first and second retracting holes 51H1 and 51H2 are formed, there is no decrease of a suction force of the suction duct 51. As a result, the occurrence of feeding failure of sheets can be prevented.

Figure 13:
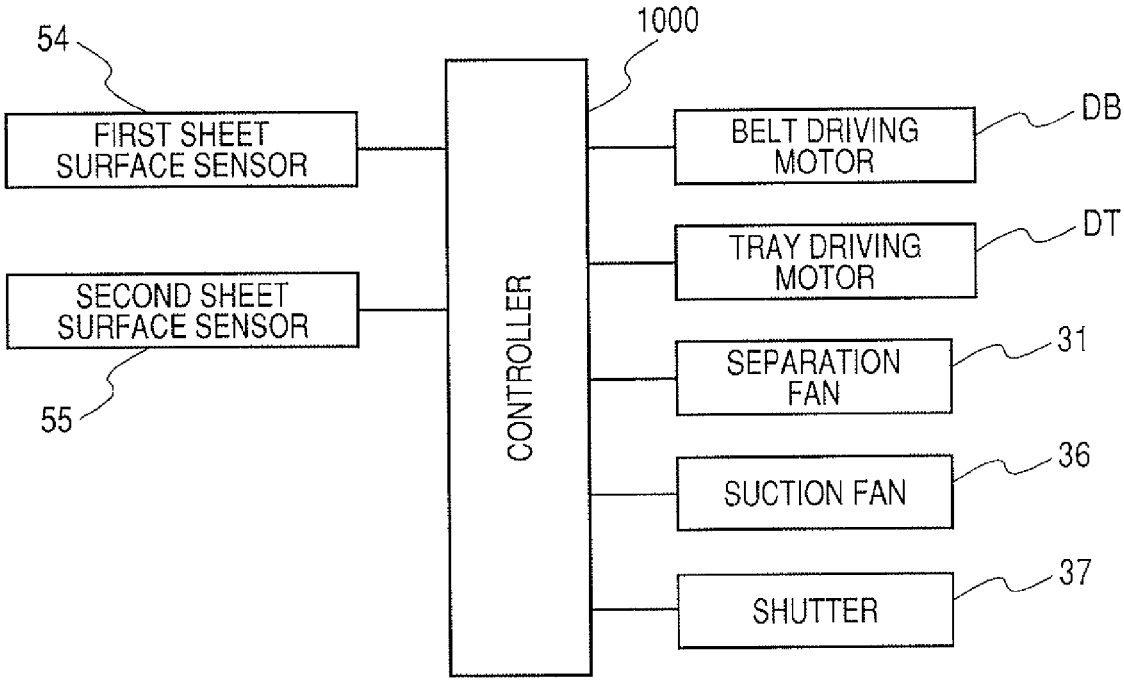
FIG. 13 is a block diagram for making control of the above-mentioned sheet feeding device.

Moreover, FIG. 13 is a block diagram for making control of the sheet feeding device 103. In response to detection signals from each sensor, the controller 1000 controls the belt driving unit DB, the tray driving unit DT, the separation fan 31, the suction fan 36, the suction shutter 37 and the like as described above.

As described above, due to that the first and second sheet surface sensors 54 and 55 are disposed in a position spaced apart from the conveying portion 50A, upsizing of a sheet feeding device 103 can be prevented. Furthermore, due to that these sensors 54 and 55 are turned ON/OFF with the sheet surface detecting member 61 via the sheet surface detecting sensor flag 52, an optimum sheet surface detection can be made even if sheets S are curled, thus enabling to reliably feed sheets.

This application claims the benefit of Japanese Patent Application No. 2006-102578, filed Apr. 3, 2006, which is hereby incorporated by reference herein in its entirety.

What is claimed is:

1. An image forming apparatus, which forms an image on a sheet fed from a sheet feeding device in an image forming portion, the sheet feeding device comprising:

a tray which supports sheets;

an air blowing portion which blows air to an end portion of the sheets supported by the tray;

a conveying portion which sucks and conveys the sheet blown upward with air blown by the air blowing portion; and a sheet surface detecting mechanism, which detects a position of an upper surface of the sheet blown upward, the sheet surface detecting mechanism including:

a sensor portion disposed at a position spaced apart from the conveying portion and upstream of the conveying portion in a sheet conveying direction;

a sensor flag which turns the sensor portion ON and OFF;

a sheet surface detecting member connected to the sensor flag and being disposed to right below the conveying portion, the sheet surface detecting member being extended in parallel with a sucking surface of the conveying portion from a side on which the sensor portion is disposed toward a downstream in the sheet conveying direction, wherein a sheet in contact with any longitudinal position of said sheet surface detecting member will move said sheet surface detecting member in a parallel state with the sheets.

2. An image forming apparatus according to claim 1, wherein the conveying portion includes: a plurality of conveying belts disposed in a direction perpendicular to the sheet conveying direction; a suction duct disposed inside the plurality of conveying belts; and a suction fan generating a negative pressure in the suction duct, and wherein with an upstream end of the sheet surface detecting member in the sheet conveying direction being connected to the sensor flag, and a downstream end of the sheet surface detecting member being connected to a support member of which one end side is pivotally disposed in the suction duct, and of which the other end side protrudes from between the plurality of conveying belts, the sheet surface detecting member, the sensor flag, and the support member forms a link which moves the sheet surface detecting member in parallel in a vertical direction.

3. An image forming apparatus according to claim 2, wherein the suction duct is provided with an opening through which the support member rotatable in the vertical direction is protruded, and wherein when a sheet is sucked to the sucking and conveying belt, the sheet surface detecting member is retracted into a side of the suction duct by a sucked sheet to close the opening.

4. An image forming apparatus according to claim 1, wherein the sensor portion is provided with a first and a second sensors, the sensor flag is provided with a first and a second detecting portions to be detected by the first and second sensors, and wherein when air is blown to sheets by the air blowing portion, the sheet surface detecting member is moved by an uppermost sheet blown up so that each sensor is selectively turned ON/OFF by an associated detecting portion of the sensor flag, and the tray is lifted or lowered based ON/OFF of each sensor to keep the uppermost sheet blown up in a position in which the sheet can be sucked and conveyed by the conveying portion.

* * * * *